US012674266B2

(12) United States Patent
Kim et al.

(10) Patent No.: US 12,674,266 B2
(45) Date of Patent: Jul. 7, 2026

(54) LAUNDRY TREATING APPARATUS

(71) Applicant: LG ELECTRONICS INC., Seoul (KR)

(72) Inventors: Sungyong Kim, Seoul (KR); Injae Han, Seoul (KR); Kanghun Lee, Seoul (KR); Woore Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 138 days.

(21) Appl. No.: 18/714,957

(22) PCT Filed: Nov. 30, 2022

(86) PCT No.: PCT/KR2022/019185
§ 371 (c)(1),
(2) Date: May 30, 2024

(87) PCT Pub. No.: WO2023/101407
PCT Pub. Date: Jun. 8, 2023

(65) Prior Publication Data

US 2025/0027254 A1 Jan. 23, 2025

(30) Foreign Application Priority Data

Nov. 30, 2021 (KR) ..... 10-2021-0168424

(51) Int. Cl.
*D06F 39/04* (2006.01)
*D06F 37/26* (2006.01)
(Continued)

(52) U.S. Cl.
CPC ..... *D06F 39/04* (2013.01); *D06F 37/26* (2013.01); *D06F 37/30* (2013.01); *D06F 39/028* (2013.01); *D06F 2103/18* (2020.02)

(58) Field of Classification Search
CPC ..... D06F 21/02; D06F 21/04; D06F 23/02; D06F 23/04; D06F 25/00; D06F 37/04;
(Continued)

(56) References Cited

U.S. PATENT DOCUMENTS

2005/0262886 A1* 12/2005 Kim ..... D06F 37/20 68/24
2007/0137260 A1 6/2007 Shikamori et al.
(Continued)

FOREIGN PATENT DOCUMENTS

KR 10-2019-0016866 A 2/2019

OTHER PUBLICATIONS

International Search Report and Written Opinion of the International Searching Authority for International Application No. PCT/KR2022/019185, dated Mar. 23, 2023.

*Primary Examiner* — David G Cormier
(74) *Attorney, Agent, or Firm* — Birch, Stewart, Kolasch & Birch, LLP

(57) ABSTRACT

A laundry treating apparatus can include a cabinet including an inlet, a tub disposed inside the cabinet, the tub being configured to hold water, a drum disposed inside the tub, the drum including a conductive material and being configured to rotate, a driver including a rotation shaft, the driver being disposed at a rear of the tub and being configured to rotate the drum, and an induction module coupled to an outer circumferential surface of the tub, the induction module being configured to generate a magnetic field for heating the drum. Also, a position of the induction module is shifted by an angle within a range from 0 degrees to 45 degrees away from an upper end of the tub that overlaps with the rotation shaft of the driver.

17 Claims, 9 Drawing Sheets

(51) Int. Cl.
*D06F 37/30* (2020.01)
*D06F 39/02* (2006.01)
*D06F 103/18* (2020.01)

(58) Field of Classification Search
CPC ..... D06F 37/26; D06F 37/267; D06F 37/30; D06F 39/028; D06F 39/04; D06F 58/26; D06F 2103/18; D06F 2105/28
See application file for complete search history.

(56) References Cited

U.S. PATENT DOCUMENTS

| | | | | |
|---|---|---|---|---|
| 2008/0189875 | A1* | 8/2008 | Czyzewski | D06F 39/088 8/159 |
| 2012/0090361 | A1* | 4/2012 | Greger | D06F 39/02 68/13 R |
| 2015/0354123 | A1 | 12/2015 | Kim et al. | |
| 2019/0186068 | A1* | 6/2019 | Kim | D06F 58/26 |
| 2019/0264375 | A1* | 8/2019 | Park | D06F 58/26 |
| 2020/0048816 | A1 | 2/2020 | Kim et al. | |
| 2020/0048819 | A1 | 2/2020 | Lee et al. | |

* cited by examiner

[Fig. 1]
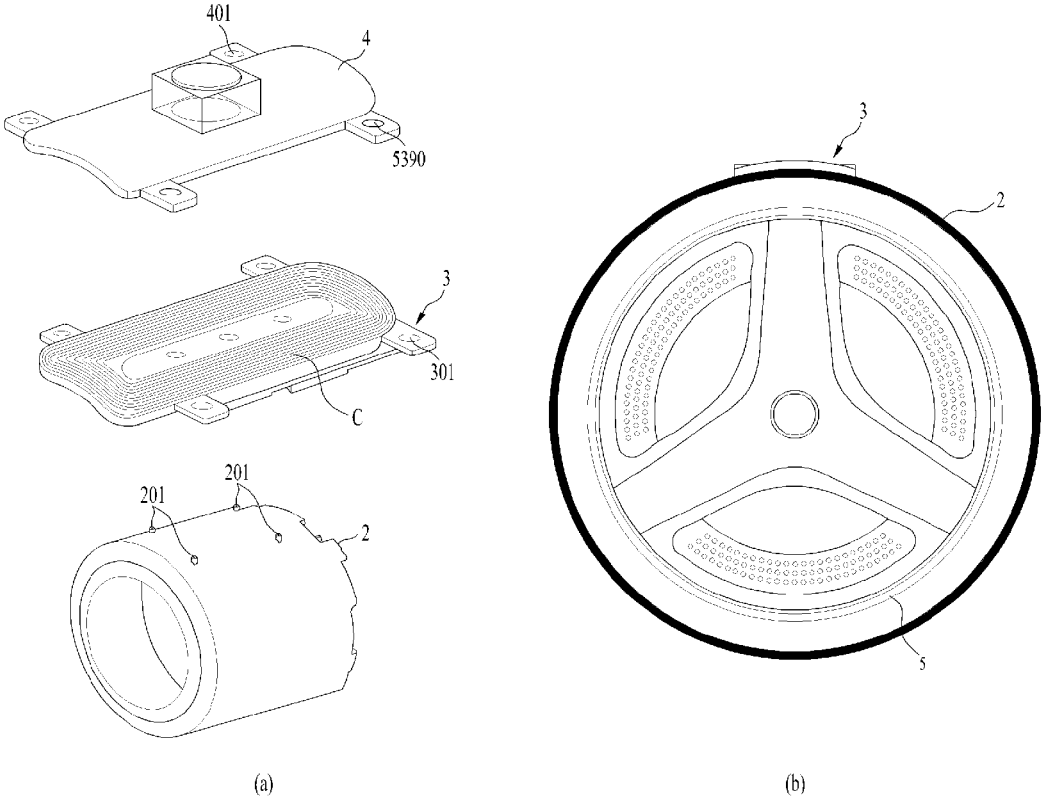

[Fig. 2]
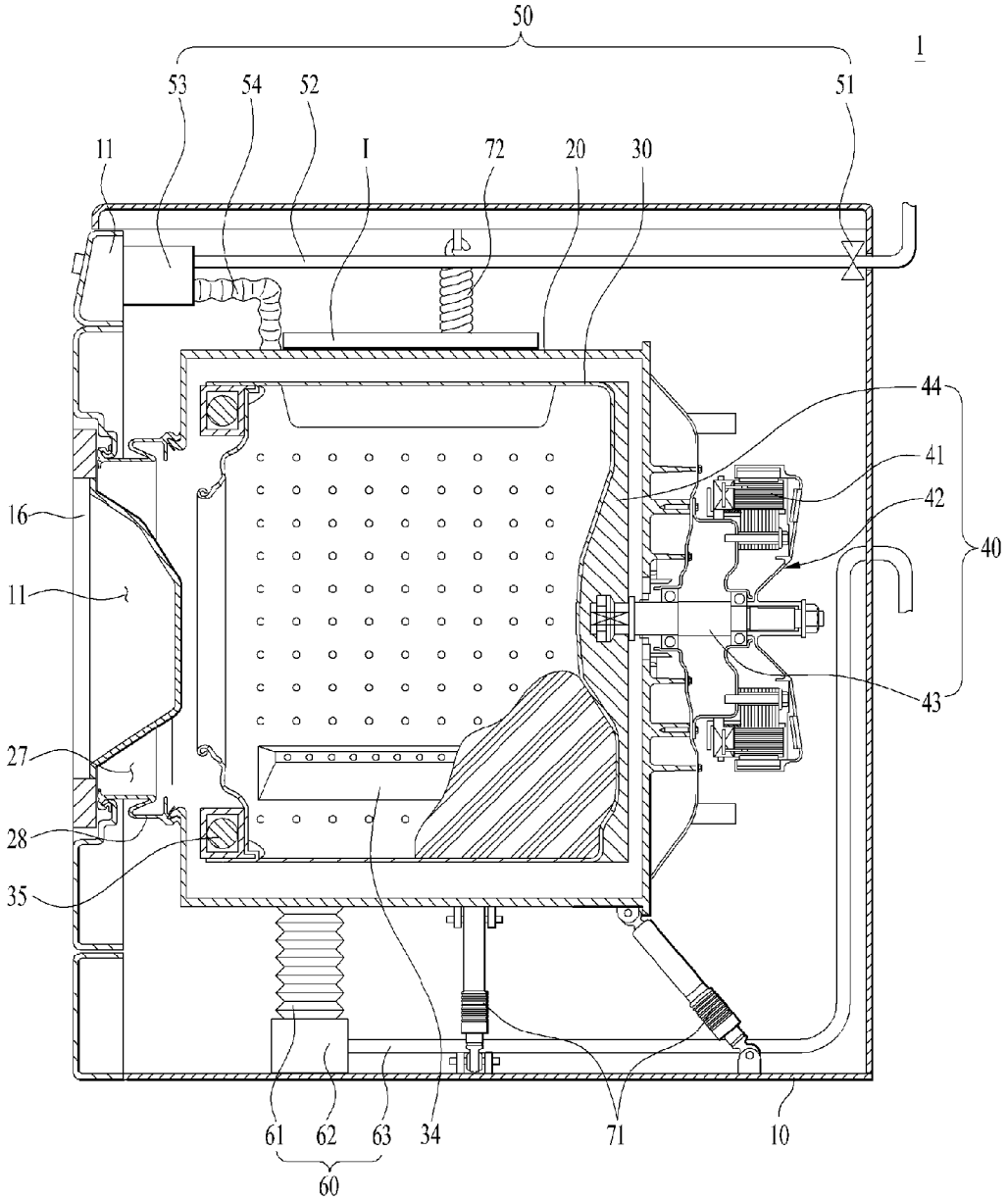

[Fig. 3]
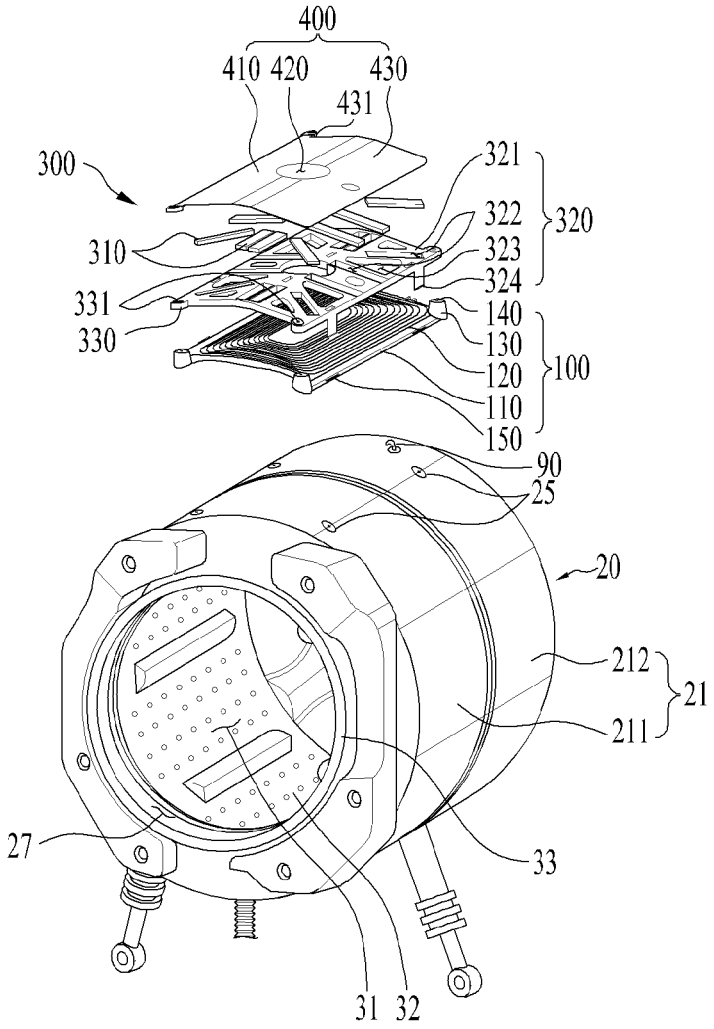

[Fig. 4]
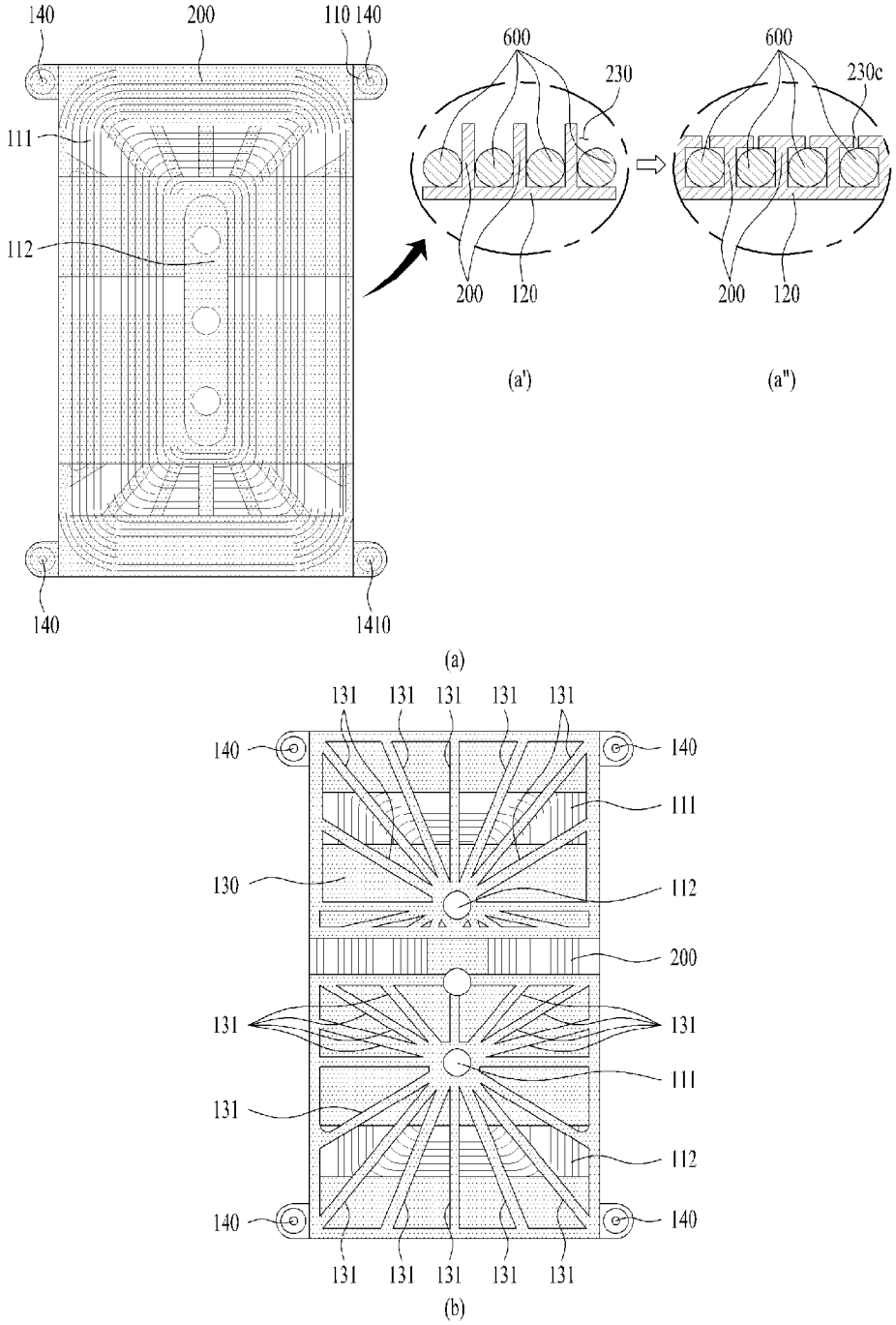

[Fig. 5]
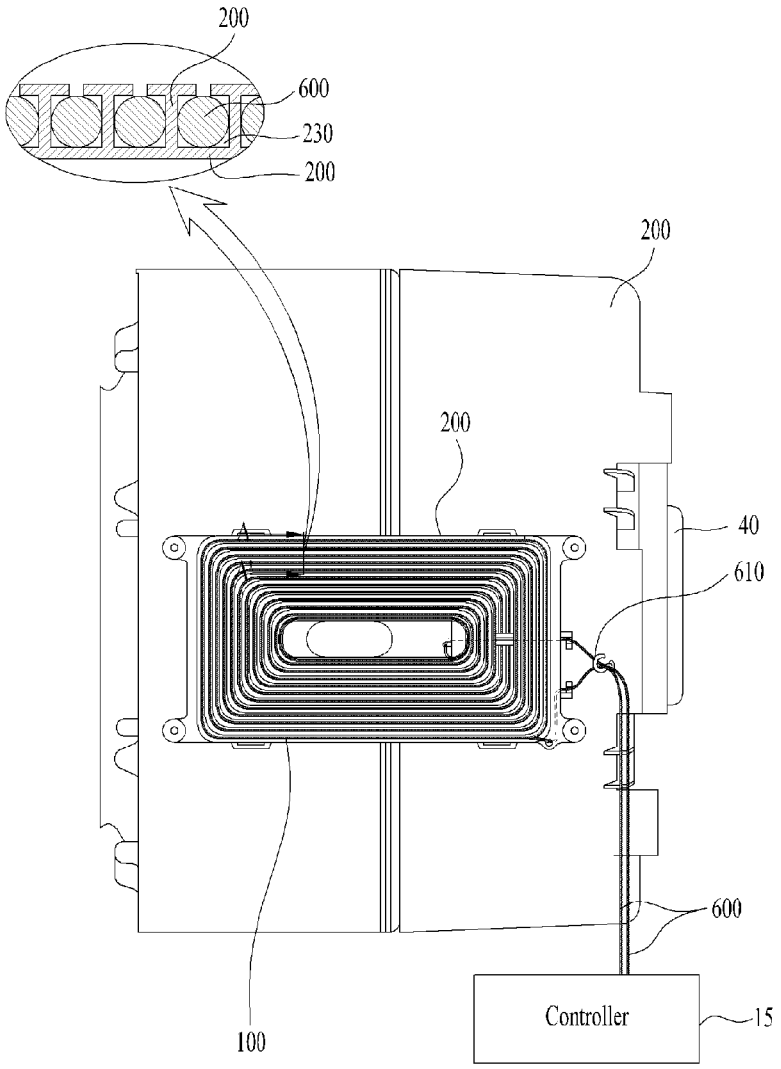

[Fig. 6]
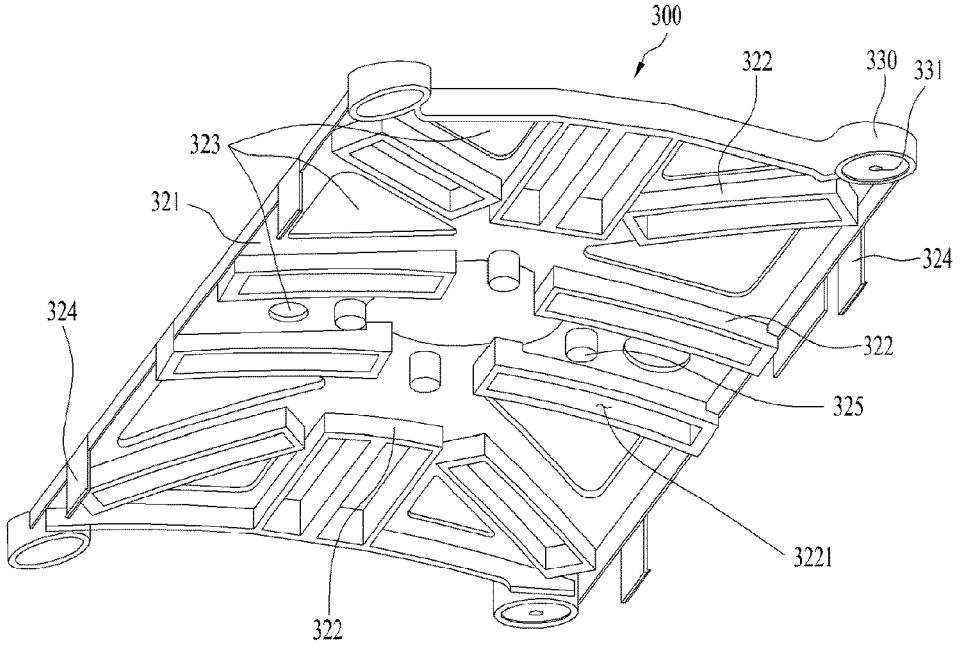
[Fig. 7]
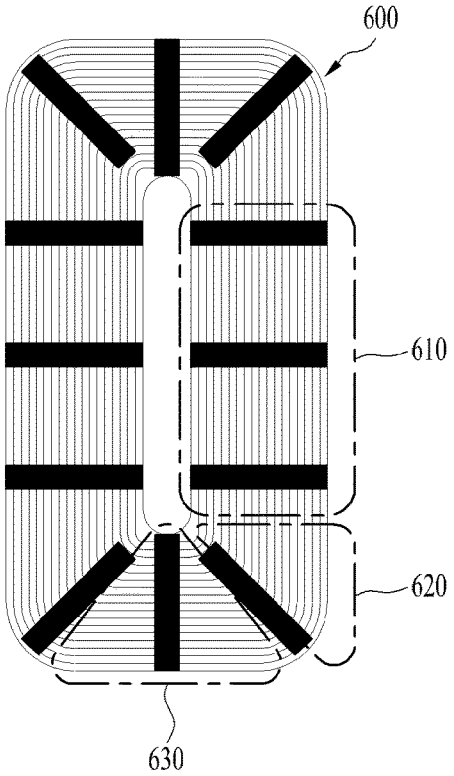

[Fig. 8]
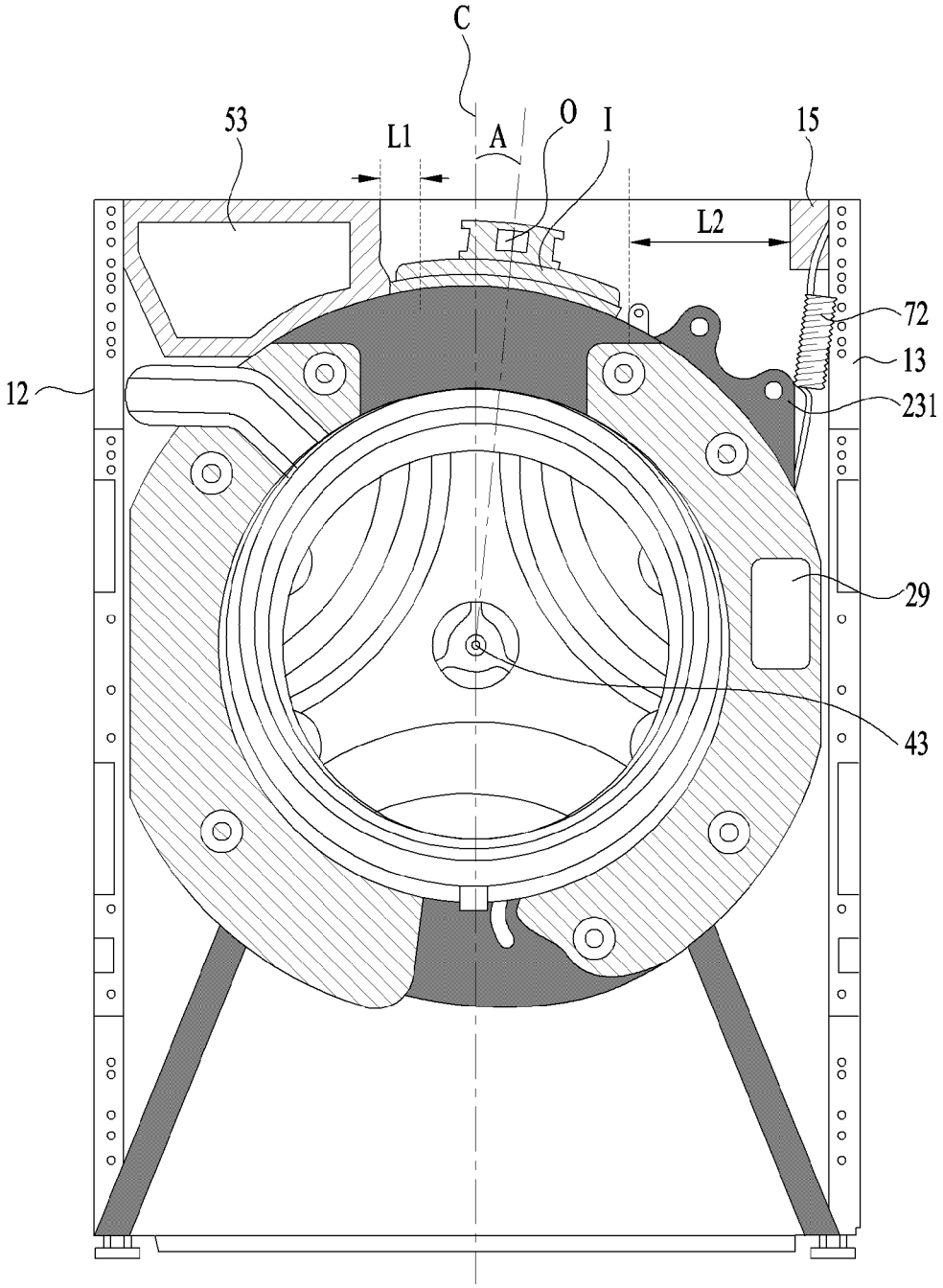

[Fig. 9]
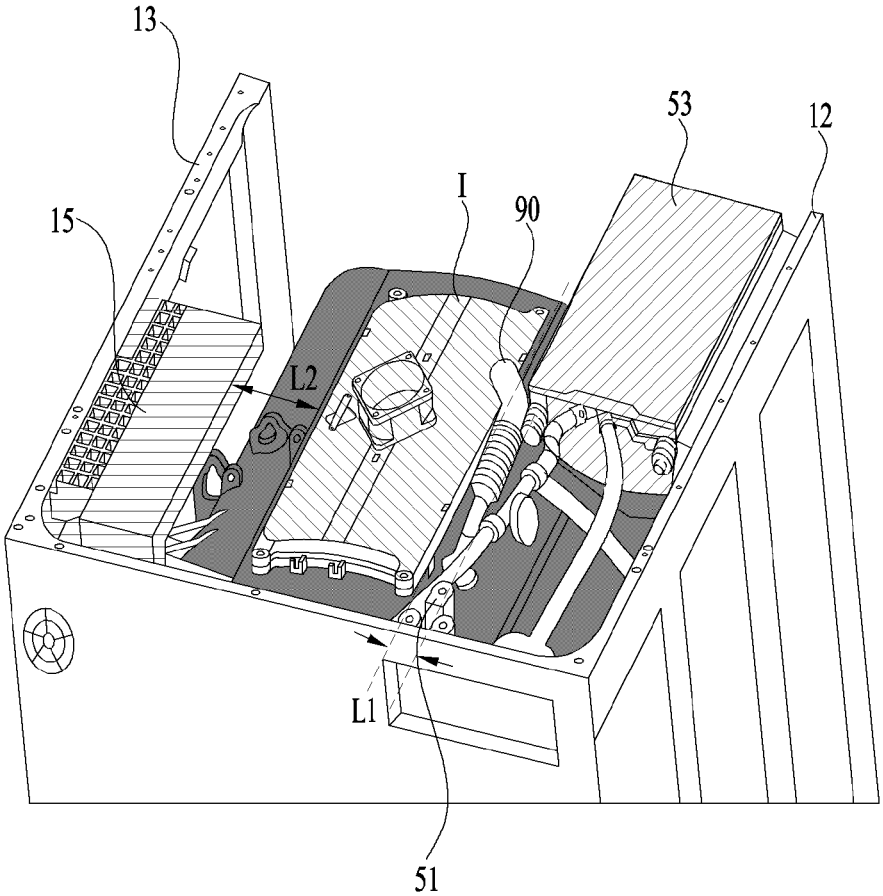
[Fig. 10]
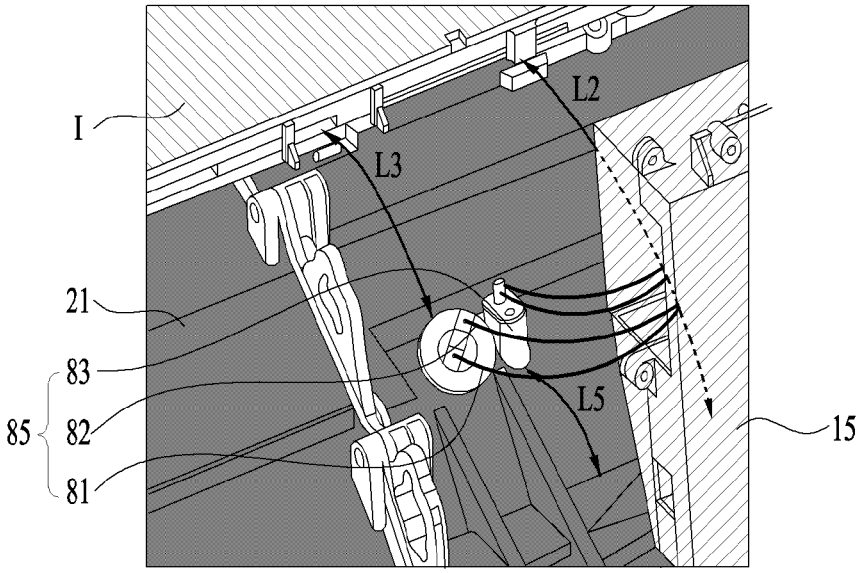

[Fig. 11]
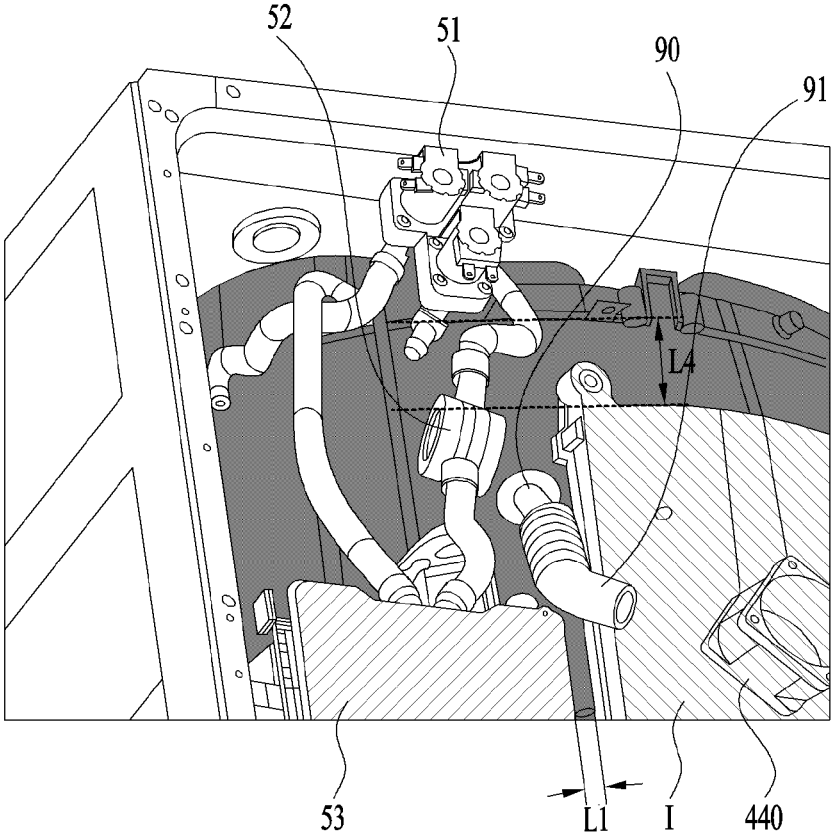

LAUNDRY TREATING APPARATUS

CROSS REFERENCE TO RELATED APPLICATIONS

This application is a National Phase application under 35 U.S.C. 371 of International Application No. PCT/KR2022/019185, filed on Nov. 30, 2022, which claims priority to Korean Application No. 10-2021-0168424, filed on Nov. 30, 2021, the entireties of all these applications are incorporated by reference herein into the present application.

BACKGROUND

1. Technical Field

The present disclosure relates to a laundry treating apparatus.

2. Discussion of the Related Art

In general, laundry treating apparatuses include various types of laundry treating apparatuses, such as a washing machine with a main purpose of laundry washing, a washing machine with a main purpose of drying, and a refresher with a main purpose of refreshing.

In the laundry treating apparatus, the washing refers to a process of removing contaminants from clothes by adding water and detergent and using a mechanical action, and the drying refers to a process of removing moisture contained in wet laundry.

A laundry treating apparatus can be configured to heat the laundry or water in order to increase a washing efficiency or dry the laundry.

In a related art example laundry treating apparatus, a heater is directly inserted into a tub for accommodating water therein to heat water, or the laundry and water are heated in a scheme of supplying hot air into a drum that holds the laundry therein.

However, because the scheme of heating water with the heater should satisfy a condition that the heater should always be submerged in the water, there is a fundamental limitation that the laundry is not able to be heated when there is no water.

In addition, the scheme of supplying hot air to the drum has a problem in that the configuration becomes rather complicated because a duct through which the hot air is circulated or supplied, a heat pump system that separately heats the air in the duct, and the like should be installed, and has a fundamental limitation that the laundry or water is not able to be heated with the hot air when water is inside the drum.

In order to solve such problem, recently, a laundry treating apparatus that directly heats a drum made of metal via an induced current has appeared (see Korean Patent Publication Application No. 10-2019-0016866).

FIG. 1, including parts (a) and (b), shows a related art example laundry treating apparatus that directly heats a drum via an induced current.

Referring to part (a) in FIG. 1, the related art example laundry treating apparatus may include a tub 2 for accommodating a drum made of metal therein, and an induction module 3 coupled to the tub to generate an induced current in the drum.

The induction module 3 may generate an induced magnetic field to generate an eddy current in the drum, and heat the drum itself while the eddy current generated in the drum is converted into thermal energy.

Accordingly, the laundry treating apparatus may always dry the laundry or heat water by heating the drum as needed, regardless of whether the drum includes water or not.

The induction module 3 may be coupled to and fixed to the tub 2, and may be coupled to an outer circumferential surface of the tub 2 to prevent a collision with the drum. Because the tub 2 is made of a plastic material, the magnetic field generated by the induction module 3 may be transmitted to the drum as it is.

Because a drain pump is disposed below the tub 2 and side panels of the cabinet are adjacent to both side portions of the outer circumferential surface of the tub 2, the induction module 3 is generally disposed on top of the tub 2.

In this regard, because the induction module 3 applies an additional mass to the tub 2, it may be advantageous from a viewpoint of vibration dynamics and center of gravity that the induction module 3 is disposed at an upper end of the tub 2 and is formed symmetrically with respect to a vertical line.

However, the induction module 3 has certain volume and height, and a spacing between the upper end of the tub 2 and a top panel of the cabinet is relatively small. In addition, because the tub 2 is formed in a cylindrical shape and the cabinet is formed in a rectangular parallelepiped shape, the widest space may be secured between each of both side surfaces of the cabinet and the tub 2.

To this end, for the related art example laundry treating apparatus, an idea was proposed in the patent publication that the induction module 3 is disposed on top of the tub 2 to be biased to one side.

However, unlike general components, the induction module 3 generates an electromagnetic field and emits the electromagnetic field to the outside. Therefore, when the induction module 3 is disposed on the top of the tub 2 to be biased to one side, the induction module 3 may interfere with an electronic device disposed on each of both side surfaces of the cabinet. For example, the induction module 3 may impair or contain placement of a control panel, a user interface, or other components.

Therefore, when a position of the induction module 3 is changed as in the related art example laundry treating apparatus, there is a problem in that the laundry treating apparatus may not operate normally because noise may occur in electrical components such as a control panel, a sensor, a water supply valve, and the like adjacent to the induction module 3 or a signal may be disturbed.

In addition, when the induction module 3 is disposed to be biased to one side (e.g., by an angle equal to or greater than 45 degrees) from an upper end of the tub T as in the related art example laundry treating apparatus, as a center of gravity of the tub T is changed, there is a problem in that vibrational stability of the tub 2 is rapidly reduced.

In particular, because excessive vibration is transmitted to the induction module I, there is a problem in that stability of coupling between the induction module I and the tub T is not able to be secured.

Therefore, in a situation of the laundry treating apparatus equipped with the induction module 3, further research on an optimal design position of the induction module I is required.

SUMMARY OF THE DISCLOSURE

An object of present disclosure is to provide an optimal installation position of an induction module that may minimize influence of the induction module on electronic parts disposed inside a cabinet.

Another object of present disclosure is to provide a laundry treating apparatus capable of preventing interference between an inner component and the induction module while utilizing a space between the cabinet and a tub.

An object of present disclosure is to provide an optimal position that may secure vibrational stability of the tub to which the induction module is coupled.

Another object of present disclosure is to provide an optimal position that may secure stability of coupling between the induction module and the tub.

According to embodiments of the present disclosure, an induction module may be coupled to an upper portion of an outer circumferential surface of the tub to be biased to one side such that a space between the upper portion of the outer circumferential surface of the tub and the cabinet may be secured. In this regard, the induction module may be disposed to be biased to the left and right within a range capable of occupying an upper end of the tub.

The induction module may be disposed to be biased in a direction away from a detergent box to avoid the detergent box disposed on the top of the tub, and may be disposed farther away from electronic products than from the detergent box to avoid applying an electromagnetic field to the electronic products such as a control panel, a sensor, and the like.

The induction module may be disposed on the top of the tub to be biased by an angle within a range from 0 degrees to 45 degrees based on the rotation shaft, and may preferably be biased by an angle within a range from 0 degrees to 10 degrees (e.g., 5 degrees) to be closer to the upper end of the tub than to a side surface of the tub.

The induction module may be installed such that at least a portion thereof is not disposed in a region forming an angle with the upper end of the tub within a range from 45 degrees to 90 degrees based on the rotation shaft.

In addition, the induction module may be disposed to be biased from an upper end of the tub in a direction away from the detergent box and may be disposed closer to the detergent box than to the other side panel.

The control panel may be mounted on the other side panel to control at least one of the driver and the induction module, and the induction module may be disposed between the detergent box and the control panel and may be closer to the detergent box than to the control panel.

A spacing between the induction module and the control panel may be greater than a spacing between the induction module and the detergent box.

An angle between the induction module and the control panel based on the rotation shaft may be set greater than an angle between the induction module and the detergent box based on the rotation shaft.

The laundry treating apparatus may further include a sensor disposed between the induction module and the other side panel, coupled to the upper portion of the outer circumferential surface of the tub, and sensing a water level or a temperature of the tub, and the induction module may be disposed on top of the tub to be biased in a direction away from the detergent box and may be disposed closer to the detergent box than to the sensor.

A water supply valve coupled to a rear surface of the cabinet and supplying the water to the detergent box may be included, and the induction module may be disposed to be biased from the upper end of the tub in a direction away from the water supply valve.

The laundry treating apparatus according to the present disclosure may further include a support coupled to the other side panel to support the tub. The induction module may be disposed closer to the detergent box than to the support.

The laundry treating apparatus may further include a water supply valve coupled to a rear surface of the cabinet and supplying the water to the detergent box, and the induction module may be disposed to be biased from the upper end of the tub in a direction away from the water supply valve.

A distance the induction module is spaced apart from the water supply valve may be greater than a distance the induction module is spaced apart from the detergent box.

The induction module may be disposed to be biased from an upper end of the tub in a direction away from the detergent box, and may be disposed to be biased within a range for at least a portion thereof to occupy the upper end of the tub.

A breathing hole extending through an upper portion of the outer circumferential surface of the tub to allow an interior of the tub and an interior of the cabinet to be in communication with each other may be disposed in the laundry treating apparatus. The induction module may be disposed to be biased from an upper end of the tub to one side to avoid the breathing hole. The breathing hole may be defined to be biased from the upper end of the tub to the other side.

The induction module may be disposed to be biased from the upper end of the tub to one side in a direction away from the detergent box, and the breathing hole may be defined between the detergent box and the induction module.

The induction module may be disposed closer to the breathing hole than to a side panel of the cabinet.

The present disclosure may provide the optimal installation position of the induction module that may minimize the influence of the induction module on the electronic parts disposed inside the cabinet.

The present disclosure may prevent or minimize interference between the inner components and the induction module while utilizing the space between the cabinet and the tub.

The present disclosure may provide the optimal position that may secure the vibrational stability of the tub to which the induction module is coupled.

The present disclosure may provide the optimal position that may secure the stability of the coupling between the induction module and the tub.

BRIEF DESCRIPTION OF THE DRAWINGS

The above and other objects, features, and advantages of the present disclosure will become more apparent to those of ordinary skill in the art by describing example embodiments thereof in detail with reference to the attached drawings, which are briefly described below.

FIG. 1, including parts (a) and (b), shows an induction arrangement of a related art example laundry treating apparatus.

FIG. 2 shows a structure of a laundry treating apparatus according to an embodiment of the present disclosure.

FIG. 3 shows an induction module of a laundry treating apparatus according to an embodiment of the present disclosure.

FIG. 4, including parts (a), (a'), (a") and (b), shows a base structure of an induction module according to an embodiment of the present disclosure.

FIG. 5 shows a structure in which a coil is wound in an induction module according to an embodiment of the present disclosure.

FIG. 6 shows a structure for installing permanent magnets in an induction module according to an embodiment of the present disclosure.

FIG. 7 shows a coil structure of an induction module according to an embodiment of the present disclosure.

FIG. 8 shows an arrangement of an induction module in a laundry treating apparatus according to an embodiment of the present disclosure.

FIG. 9 shows a positional relationship between the induction module and a control panel according to an embodiment of the present disclosure.

FIG. 10 shows a positional relationship between the induction module and a sensor according to an embodiment of the present disclosure.

FIG. 11 shows a positional relationship between the induction module, a water supply valve, and a breathing hole according to an embodiment of the present disclosure.

DETAILED DESCRIPTION OF THE EMBODIMENTS

Hereinafter, embodiments disclosed herein will be described in detail with reference to the accompanying drawings. Herein, the same or similar reference numerals are assigned to the same or similar components even in different embodiments, and a description of the same or similar components is replaced with the first description. Singular expressions used herein include plural expressions unless the context clearly dictates otherwise. In addition, in describing the embodiment disclosed herein, when it is determined that detailed descriptions of related known technologies may obscure the gist of the embodiment disclosed herein, the detailed descriptions thereof will be omitted. In addition, it should be noted that the accompanying drawings are only for easy understanding of the embodiment disclosed herein, and do not limit the technical idea disclosed herein.

The features of various embodiments of the present disclosure can be partially or entirely coupled to or combined with each other and can be interlocked and operated in technically various ways, and the embodiments can be carried out independently of or in association with each other.

FIG. 2 shows a configuration of a laundry treating apparatus according to an embodiment of the present disclosure.

A laundry treating apparatus 1 according to an embodiment of the present disclosure may include a cabinet 10 that forms an outer appearance of the apparatus, a tub 20 disposed inside the cabinet, and a drum 30 that is rotatably accommodated inside the tub 20, and accommodates laundry (or an object-to-be-dried or an object-to-be-refreshed) therein.

The cabinet 10 may include an inlet 17 defined in a front surface of the cabinet 10 and through which the laundry (or the object-to-be-dried or the object-to-be-refreshed) is taken in and out. The cabinet 10 may include a door 16 pivotably mounted on the cabinet to open and close the inlet 17.

The door 16 may be composed of an annular door frame and a viewing window disposed at a central portion of the door frame.

The tub 20 is formed in a cylindrical shape with a longitudinal axis parallel to or maintaining an angle of 0 to 30° with a bottom surface of the cabinet to define a space in which water may be stored, and has a tub inlet 27 defined in a front surface thereof to be in communication with the inlet 17 of the cabinet 10.

The tub 20 may be supported by a support and fixed inside the cabinet 10.

The support may include a damper 71 for supporting a bottom surface of the tub 20 and a spring 72 for supporting a top surface of the tub 20.

Accordingly, vibration transmitted to the tub 20 by rotation of the drum 30 may be attenuated.

The drum 30 is formed in a cylindrical shape with a longitudinal axis parallel to or maintaining an angle of 0 to 30° with the bottom surface of the cabinet to accommodate the laundry (or the object-to-be-dried or the object-to-be-refreshed) therein, and has a drum inlet 31 defined in a front surface thereof to be in communication with the tub inlet 27 (e.g., see FIG. 3).

Therefore, a user may put the laundry (or the object-to-be-dried or the object-to-be-refreshed) into an inner space of the drum 30 via the inlet 17 of the cabinet 10, the tub inlet 27, and the drum inlet 31, or withdraw the laundry (or the object-to-be-dried or the object-to-be-refreshed) from the inner space of the drum 30.

In addition, with reference to FIG. 3, the drum 30 may include a drum outer circumferential surface 32 for accommodating the laundry therein and a drum rear surface 33 disposed at the rear of the drum and coupled to a driver 40.

The drum outer circumferential surface 32 includes multiple through-holes or drainage holes defined therein. This is to allow water stored in the tub 20 to flow into the drum as well as to allow water discharged from the laundry (or the object-to-be-dried or the object-to-be-refreshed) to be discharged to an inner space of the tub 20 (e.g., to drain between the tub 20 and the drum 30).

A lifter 34 (e.g., one or more paddles) for stirring the laundry (or the object-to-be-dried or the object-to-be-refreshed) when the drum rotates may be further disposed on an inner circumferential surface of the drum 30.

The drum 30 may further include a balancer 35 coupled to the drum outer circumferential surface 32 from the front to compensate for eccentricity or unbalanced load inside the drum 30.

A plurality of balls or fluid (e.g., a mass dampener) having a mass for compensating for the eccentricity may be accommodated inside the balancer 35.

The laundry treating apparatus 1 according to the present disclosure may include the driver 40 for rotating the drum 30.

The driver 40 may be coupled to the tub 20 to rotate the drum 30. The driver 40 may be composed of a stator 41 fixed to a rear surface of the tub 20 to generate a rotating magnetic field, a rotor 42 that rotates by an electromagnetic action with the stator 41, and a rotation shaft 43 that extends through the rear surface of the tub 20 and connects the drum rear surface 33 and the rotor 42 to each other.

In addition, the driver 40 may further include a spider 44 coupled to the drum rear surface 33 to rotate the drum 30.

The spider 44 may be configured as the rotation shaft 43 extends, and one surface thereof may be coupled to the drum rear surface 33 and may be coupled to the rotor 42 via the rotation shaft 43.

In one example, the laundry treating apparatus 1 according to one embodiment of the present disclosure may further include water supply means 50 for receiving water from the outside.

The water supply means 50 may include a water supply valve 51 coupled to the cabinet 10 and in communication with an external water supply source, a water supply pipe 52 extending from the water supply valve 51 and receiving water, a detergent box 53 that receives water from the water supply pipe 52 and stores detergent therein, and a supply pipe 54 that supplies at least one of water and detergent to the tub 20 by connecting the detergent box 53 and the tub 20 to each other.

The detergent contained in the detergent box 53 may be diluted with water introduced from the water supply pipe 52 and supplied to the tub 20 via the supply pipe 53.

The detergent box 53 may include a housing fixed in a space between the top surface of the tub 20 and the cabinet 10, and a detergent accommodating portion configured to be extended in a forward direction from and retracted into the housing.

The laundry treating apparatus according to one embodiment of the present disclosure may further include a drainage 60 that discharges water inside the tub 20 to the outside of the cabinet 10.

The drainage 60 may include a drain pipe 61 that discharges water from the tub 20, a drain pump 62 connected to the drain pipe 61 to provide power for discharging the water to the outside of the cabinet 10, and an extension pipe 63 extending from the drain pump 62 to the outside of the cabinet 10.

Preferably, the drain pump 62 and the drain pipe 61 are disposed below the tub 20 such that water in the tub 20 is more easily discharged by gravity.

In one example, a gasket 28 may be disposed between the inlet of the cabinet 10 and the tub inlet 27. The gasket 28 may prevent water inside the tub 20 from leaking into the cabinet 10. In addition, the gasket 28 may be made of an elastic material to prevent vibration of the tub 20 from being transmitted to the cabinet 10.

The laundry treating apparatus 1 according to the present disclosure may include an input panel 11 for receiving a command to operate the laundry treating apparatus on a front surface thereof.

The input panel 11 may be configured to receive a series of commands for supplying power to the laundry treating apparatus or for the laundry treating apparatus to perform a washing course or a drying course for washing or drying the laundry.

The input panel 11 (e.g., user interface) may be formed as a user interface and may include display means such as a liquid crystal or a light to display information of the laundry treating apparatus.

The laundry treating apparatus according to the present disclosure may be configured to perform the heating of water, and drying and refreshing (steam treatment) of the laundry (or the object-to-be-dried or the object-to-be-refreshed).

To this end, the laundry treating apparatus 1 according to an embodiment of the present disclosure may include an induction module I for heating the drum 30.

The induction module I may be utilized when performing at least one function of washing, drying, and refreshing (e.g., a steaming operation).

The induction module I may be mounted on the outer circumferential surface of the tub 20 (e.g., see FIG. 3), and a coil 600 formed by winding an electric wire may be installed inside the induction module I. The induction module I serves to heat the circumferential surface of the drum 30 via a magnetic field generated by applying a current to the coil 600 (e.g., see FIG. 5).

When describing a scheme in which the induction module I heats the drum 30, an alternating current whose phase changes flows to the coil 600 located outwardly of the circumferential surface of the drum 30 and the coil 600 forms a radial alternating magnetic field based on the Ampere's circuital law. For example, a changing magnetic field can heat the metal drum 30 via eddy currents.

Such alternating magnetic field is concentrated around the drum 30 made of a conductor with high magnetic permeability. The magnetic permeability as used herein refers to an extent to which a medium is magnetized with respect to a given magnetic field. In this regard, based on the Faraday's law of induction, the eddy current is formed on the drum 30. Such eddy current flows along the drum 30 made of the conductor and then is converted into Joule heat by a resistance of the drum 30 itself, and accordingly, an inner wall of the drum 30 is directly heated.

When the inner wall of the drum 30 is directly heated, an air temperature inside the drum 30 and a temperature of the laundry in contact with the inner wall of the drum 30 rise together. Accordingly, because the laundry may be directly heated, drying may be performed faster compared to a drying apparatus using only a hot air drying scheme, which is an indirect heating scheme, or a low-temperature dehumidifying drying scheme.

In addition, even when the laundry treating apparatus according to an embodiment of the present disclosure is formed as the washing machine as well as the dryer, water may be heated even without a separate heating wire and flow channel exposed inside the tub 20, and water may continuously come into contact with the inner and outer walls of the drum 30. Therefore, faster water heating may be achieved compared to a scheme in which the separate heater is formed at a lower portion of the tub 20 and water is heated using the heater, and a complicated design can be avoided.

FIG. 3 shows an embodiment of the induction module I of the laundry treating apparatus according to an embodiment of the present disclosure.

The induction module I is mounted on the circumferential surface of the tub 20 and heats the circumferential surface of the drum 30 via the magnetic field generated by applying the current to the coil 600 around which the wire is wound.

The induction module I may include a base 100 for installing the coil 600 on a top surface of the tub 20. The base 100 may be fixed to the circumferential surface of the tub 20, and may extend over the rotation shaft 43 and be disposed on a horizontal surface parallel to the ground.

The base 100 may be formed in a rectangular plate shape or rectangular shape having a predetermined thickness, and a length in the front and rear direction thereof may be greater than a width corresponding to a circumferential direction of the tub 20. Also, the base 100 may be formed in a rectangular plate shape that is slightly curved or rounded to correspond to a curved surface of the tub 20.

The base 100 may include a base body 110 that may be disposed on the outer circumferential surface of the tub 20, a seating surface 120 disposed on a top surface of the base body 110 and on which the coil 600 is wound, a bottom surface 130 disposed on a bottom surface of the base body 110 and facing the outer circumferential surface of the tub 20, and a fixing portion 140 for coupling the base body 110 to the outer circumferential surface of the tub 20.

At least one of the base body 110 and the seating surface 120 may have a curved cross-section to concentrate a magnetic field generated from the coil 600 to the drum 30.

In addition, with reference to FIGS. 4 and 5, the base 100 may have seating ribs 200 protruding upward from the seating surface 120 and on which the coil is wound. The seating ribs 200 may extend outwardly from the seating surface 120 like a screw to define an installation space 230 in which the coil 600 is seated or inserted.

In order to concentrate the magnetic field generated by the coil 600 toward the drum 30 rather than the cabinet 10, the induction module I may include a permanent magnet 310 that is disposed on the base 100 and is a bar magnet, and a magnet cover 320 for fixing the permanent magnet 310 to the base 100 from above.

Multiple permanent magnets 310 may be arranged to be spaced apart from each other along a direction in which the coil 600 is wound. The permanent magnet 310 may be located above the coil 600, but may be disposed perpendicular to a longitudinal direction of the wire constituting the coil 600 to be simultaneously disposed above an inner portion and an outer portion of the coil.

The magnet cover 320 may further include a housing body 321 having a rectangular plate shape or rectangular shape with a predetermined thickness corresponding to the shape of the base 100, a magnet installation portion 322 defined on the housing body 321 and in which the permanent magnet 310 is seated, and an air flow hole 323 defined to extend through the housing body 321 and spaced apart from the magnet installation portion 322.

The magnet installation portion 322 may be defined to determine a space in which the permanent magnet 310 is accommodated and installed.

The induction module I may include a base cover 400 for fixing the magnet cover 320 to the base 100 and preventing the coil 600 from deviating.

The base cover 400 may include a cover body 410 having a rectangular plate shape or rectangular shape with a predetermined thickness, and an air discharge hole 420 defined in a central portion of the cover body 410 and through which hot air (air) flows by convection or in which a blowing fan 440 is seated (e.g., see FIG. 11).

The blowing fan that supplies air into the induction module I may be coupled to the base cover 400. For example, the blowing fan can be positioned in or on air discharge hole 420.

The blowing fan 440 allows air to flow into the induction module I to prevent overheating of the induction module I.

Specifically, air may be introduced into the base cover 400 via the air discharge hole 420. Inside the induction module, a space is defined between the base cover 400, a magnet coupling portion 300, and the base 100, and an air flow space is defined by an air flow hole 323 or the like. In addition, an air passing hole 111 is defined in the base body 110. Thus, air may cool the coil 600 in the inner space and may be discharged to the outside of the induction module via the air passing hole 111.

In addition, because the magnet cover 320 and the base cover 400 are formed as separate members, air may flow on a top surface of the permanent magnet 310. Thus, overheating of the permanent magnet 310 may be prevented.

In addition, because the magnet cover 320 and the base cover 400 are formed as the separate members, the permanent magnet 310 may be easily detachable, and thus, may be easily exchanged, and a part fixing the permanent magnet 310 may be easily injection-molded because of not having a closed surface.

Hereinafter, a structure for fixing the base 100, the magnet cover 320, and the base cover 400 to the tub 20 will be described.

First, the base 100 may include the fixing portion 140 disposed at a corner of the base body 110 and having a fixing hole defined therein into which the screw is inserted. The fixing portion 140 may be configured to protrude from each of both sides of front and rear ends of the base body 110. For example, the fixing portion 140 can be located at the four corners of the base 100, but embodiments are not limited thereto.

Multiple coupling portions 25 having a hollow portion in communication with the fixing hole in fixing portion 140 may be defined in the tub 20 (e.g., four mounting points on 20 as shown in FIG. 3).

In addition, the magnet cover 320 may include a magnet fixing portion 330 disposed at a corner of the housing body 321 and having a magnet fixing hole defined therein in communication with the fixing hole in fixing portion 140 and into which the screw is inserted.

The magnet fixing portion 330 may protrude from each of both sides of front and rear ends of the housing body 321 (e.g., at the four corners).

In addition, the base cover 400 may include a cover fixing portion 430 protruding from each of front and rear ends of the cover body 410 and having a cover fixing hole 431 defined there in communication with the fixing hole in fixing portion 140.

Accordingly, one screw may extend through the cover fixing hole 431—the magnet fixing hole 331—the fixing hole in fixing portion 140 and finally be fixed to the coupling portion 25.

FIG. 4 shows the base 100 of the induction module according to an embodiment of the present disclosure.

The induction module I may serve as a fixing member for fixing the coil 600 to the outer circumferential surface of the tub 20, and may include the base 100 mounted on the outer circumferential surface of the tub 20 such that the coil 600 does not deviate even when the tub 20 vibrates. The induction module I can also be referred to as an induction part I.

Part (a) in FIG. 4 shows a top surface of the base 100, and part (b) in FIG. 4 shows a bottom surface of the base 100. Part (a) in FIG. 4 includes part (a') and part (a").

Referring to part (a) in FIG. 4, the base 100 may include the base body 110 disposed on the outer circumferential surface of the tub 20, the seating surface 120 disposed such that the coil 600 is seated on the top surface of the base body 110, and the seating ribs 200 protruding from the seating surface 120 and fixed as the coil 600 is wound thereon.

The base body 110 may have the air passing hole 111 defined in a thickness direction.

The seating ribs 200 may extend to a top surface of the air passing hole 111. That is, the seating ribs 200 may be formed on the seating surface 120 regardless of a shape of the air passing hole 111.

The seating ribs 200 may extend outwardly along a circumference of the seating surface 120.

When extending outwardly, the seating ribs 200 may be spaced apart from each other by a certain spacing to define the installation space 230 in which the coil 600 is installed therebetween.

The seating ribs 200 may extend outwardly along a shape of a circle or an ellipse whose diameter gradually increases outwardly on the seating surface. In addition, the seating ribs 200 may extend in a track shape with an area increasing outwardly of the seating surface.

The track shape is a shape in which a straight portion and a curved portion are mixed with each other. The track shape may mean a shape capable of maximizing an area in which the coil 600 is seated of the seating surface 120 compared to the circular or elliptical shape.

A shape in which the coil 600 is wound may be determined based on the shape in which the seating ribs 200 extend from the seating surface 120.

The seating rib 200 may protrude or extend upwardly from the seating surface 120, and may have a height greater than a thickness of the coil 600.

The seating ribs 200 may allow turns of the wound coil 600 to be spaced apart from each other so as not to be in contact with each other, thereby preventing a short circuit. As a result, it is not necessary to coat the coil 600 wound on the seating ribs 200 with a separate insulating film or a thickness of the insulating film is able to be minimized, thereby reducing a production cost.

The seating ribs 200 may define slots or spaces between adjacent seating ribs that are narrower than a wire diameter of the coil 600 such that the coil 600 is tight-fitted or friction fitted, and a width of the installation space 230 may be in a range from 93% to 97% of the wire diameter of the coil 600.

When the coil 600 is tight-fitted into the installation space 230, even though the vibration of the tub 20 is transmitted to the coil 600, the coil 600 may be securely maintained fixed in the installation space 230. Therefore, the coil 600 does not depart from the installation space 230, and a movement of the coil 600 itself is suppressed, so that noise that may occur due to a gap may be prevented.

In one example, upper ends of the seating rib 200 may be bent after the coil 600 is inserted to shield at least a portion of a top portion of the coil 600. For example, each of the seating ribs 200 may a "T" shaped cross-section.

To this end, the upper ends of the seating ribs 200 may be bent or heat-treated.

Thus, the upper end of the seating rib 200 may form a fixing hook 221 for fixing the coil 600.

Referring to part (a) in FIG. 4, after the coil 600 is tight-fitted into the installation space 230, the seating rib 200 may be melted as a top surface thereof is pressurized. Then, the melted upper end of the molten seating rib 200 may spread to both sides to cover top surfaces of turns of the coil 600 on both sides. For example, after the coil 600 is installed, tops of the seating ribs 200 can be melted together to form a sealed surface that covers the coil 600.

As the coil 600 is tight-fitted into the installation space 230 and the upper end of the seating rib 200 is melted, a path along which the coil 600 may deviate may be physically blocked, and noise caused by the vibration of the tub 20 may be prevented by preventing the movement of the coil 600, and durability may be improved as a gap between parts is eliminated.

In the above description, it is assumed that the coil 600 is disposed on the top surface of the base 100, but the seating rib 200 may protrude downwardly of the base 100 such that the coil 600 is disposed on the bottom surface of the base 100.

Part (b) in FIG. 4 shows the bottom surface of base 100.

The air passing hole 111 may be exposed to the bottom surface 130 of the base 110.

In addition, referring to part (b) in FIG. 4, a support bar 131 may be disposed on the bottom surface of the base 110.

The support bar 131 may be configured to reinforce adhesion between the outer circumferential surface of the tub 20 and the base 100 and to reinforce rigidity of the base 100.

The base 100 may have a through-hole 112 defined at a center of the seating surface 120 where the coil 600 is not wound, and the through-hole 112 may include a plurality of through-holes spaced apart from each other by a predetermined spacing along the front and rear direction of the tub 20.

The support bar 131 may radially extend from the through-hole 112 extending through the base 100 (e.g., in a type of spoked configuration).

When the fixing portion 140 is fixed to the coupling portion 25 disposed on the outer circumferential surface of the tub 20, the outer circumferential surface of the tub 20 is pressurized by the support bar 131. Accordingly, the base 100 may be coupled to the tub 20 with a greater pressure compared to a situation in which the entire bottom surface of the base 100 is in contact with the outer circumferential surface of the tub 20. Accordingly, even when the tub 20 vibrates, the base 100 does not easily move or escape from the outer circumferential surface of the tub 20.

FIG. 5 shows a structure of the coil 600 of the induction module.

The seating ribs 200 may be formed from a position adjacent to an outermost edge of the seating surface 120 toward a center thereof, and each turn of the coil 600 may be wound between the adjacent two seating ribs 200.

Referring to a section A-A' in FIG. 5, the wire constituting the coil 600 may be tight-fitted by being in surface contact with the two adjacent seating ribs 200.

The laundry treating apparatus according to an embodiment of the present disclosure may include a control panel 15 that controls the supply of the current to the coil 600. Both ends of the coil 600 may be coupled to the control panel 15.

One end of the coil 600 may extend toward the through-hole defined at the center of the seating surface 120, and the other end thereof may extend on the seating surface 120 toward the outermost edge of the seating rib 200.

The coil 600 may extend from the control panel 15 toward the seating surface 120 via the bottom surface 130 of the base body 110, be wound on the seating ribs 200, and then be connected to the control panel 15.

In this regard, the coil wound on the seating ribs 200 may extend to the bottom surface 130 and then be connected to the control panel 15. This has an effect of preventing disconnection and deviation problems by reducing a vibration phase difference generated along a wire by allowing the coil 600 to be connected to the base 100 via the bottom surface, which is a point where a vibration displacement of the outer circumferential surface of the tub 20 is the smallest.

In one example, both ends of the coil 600 may extend to a rear portion of the tub 20 and extend to the control panel 15 (e.g., controller). This is a result of considering that an amplitude is small at the rear portion of the tub 20 because of being close to the driver 40 and thus more stable and secure.

FIG. 6 shows a detailed structure of the magnet cover 320.

The induction module I may further include the magnet cover 320 coupled to the base 100 to cover the installation space 230.

The magnet cover 320 may include a housing body 321 configured to be coupled to the top surface of the base 100 and preventing the coil 600 and the permanent magnet 310 from deviating or shaking loose.

A bottom surface of the housing body 321 may be formed to be in close contact with the upper ends of the seating ribs 200 of the base 100.

The plurality of magnet installation portions 322 protruding downwards may be defined on a bottom surface of the magnet cover 320.

The magnet installation portion 322 may provide a space for accommodating the permanent magnet 310 therein and, at the same time, may adhere closely to the upper end of the seating rib 320 to shield the seating rib 320 with a greater pressure.

As a result, despite the vibration of the tub 20, the noise caused by the gap or the deviation of the coil 600 may be prevented.

The plurality of magnet installation portions 322 may be arranged along the longitudinal direction of the coil 600. In addition, the magnet installation portion 322 may be formed perpendicular to the longitudinal direction of the coil 600. For example, the magnets can have a bar shape that can be disposed in a perpendicular direction relative to the windings of the coil 600. Therefore, the entire coil may be firmly fixed without pressing the entire coil.

In one example, the magnet installation portion 322 is preferably formed integrally with the housing body 321. Therefore, at the same time as the magnet cover 320 is coupled to the base 100, the magnet installation portion 322 presses the coil 600. Therefore, a separate means or step for pressurizing the coil 600 is not required.

The permanent magnet 310 may be inserted into and mounted in the magnet installation portion 322. Accordingly, when the permanent magnet 310 is fixed to the magnet cover 320, the permanent magnet may be fixed above the coil 600 as the magnet cover 320 is coupled to the base 100.

Because each permanent magnet 310 is preferably disposed at a specific position on the top surface of the coil 600 in order to efficiently concentrate the magnetic field in a direction of the drum 30, when the permanent magnet 310 moves by the vibration of the tub 20, not only the noise problem but also a problem of lowering a heating efficiency may occur.

More specifically, the magnet installation portion 322 may be formed of both side walls that protrude downward from the bottom surface of the magnet cover 320 and face each other, and may have an open surface 3221, such that a bottom surface of the permanent magnet 310 mounted in the magnet installation portion 322 may face one surface of the coil 600.

In this case, a movement of the permanent magnet 310 in a left and right direction may be suppressed by both of the side walls, and the open surface 3221 may allow the permanent magnet 310 to come closer to the top surface of the coil 600. In other words, four sides of the permanent magnet 310 can be surrounding by four side walls and a lower surface of the permanent magnet 310 can be covered by or overlapped with the top surface of the coil 600.

As the permanent magnet 310 is closer to the coil 600, the magnetic field is guided more intensively in the direction of the drum 30. As a result, the drum 30 may be stably and uniformly heated. For example, the open surface 3221 defined by the side walls can allow the permanent magnet 310 to be located closer to the coil 600, which can improve heating efficiency.

The magnet installation portion 322 may further include a stopper protruding inward to prevent the permanent magnet 310 from deviating downward.

In one example, the magnet cover 320 may include detachable hooks 324 that protrude downward at both corners and are detachably coupled to the base 100.

FIG. 7 shows an arrangement of the coil 600 and the permanent magnet 310 installed in the induction module I.

The coil 600 may be formed in the concentric circle, ellipse, or track shape on the outer circumferential surface of the tub 20.

The permanent magnet 310 acts as a blocking member for transmission of the magnetic field to prevent the heating of other nearby components other than the drum 30, and to increase the heating efficiency by concentrating the magnetic field generated by the coil 600 in a direction toward the drum 30.

The permanent magnet 310 may be formed as the bar magnet. The permanent magnet 310 is located above the coil 600, but is preferably disposed perpendicular to the longitudinal direction of the coil 600. This is to cover the inner portion and the outer portion of the coil at the same time.

The permanent magnet 310 may include a plurality of bar magnets having the same size, and the plurality of permanent magnets 310 may be spaced apart from each other along the longitudinal direction of the coil 600.

This is because it difficult to perform the uniform heating as an amount of magnetic field radiated to the drum 30 varies for each portion of the circumferential surface of the drum 30 when the permanent magnets 310 are placed only at specific positions. Therefore, in order to uniformly induce the magnetic field generated by the coil 600 in the direction of the drum 30, it is preferable that the plurality of permanent magnets 310 are disposed to be spaced apart from each other along the circumference of the coil 600.

Furthermore, when there are the same number of permanent magnets 310, it is preferable that the permanent magnets 310 are intensively disposed or spaced closer together in portions of the coil 600 adjacent to front and rear portions of the tub 20.

Specifically, the coil 600 may be divided into first straight portions 610 extending in a front and rear direction, curved portions 620 disposed at both ends of the straight portion, and second straight portions 630 disposed at front and rear portions of the coil 600.

The first straight portion 610 may be longer than the second straight portion 630 to correspond to the length of the drum 30.

More permanent magnets may be disposed in the curved portion 620 and the second straight portion 630, than in the first straight portion 610. Also, the permanent magnets may be spaced closer together in the curved portion 620 and the second straight portion 630, than in the first straight portion 610. As a result, the drum 30 may be uniformly heated by allowing more magnetic field to be radiated to a region with a small area of the coil 600.

FIG. 8 shows an optimal installation position of an induction module of a laundry treating apparatus according to an embodiment of the present disclosure.

The drainage 60 is installed beneath the tub 20, and the supports 71 such as the dampers 72 are disposed beneath the tub 20 on both sides of the tub 20. In addition, because a diameter of the tub 20 should be secured to be as wide as possible to expand a washing volume, both side portions of the outer circumferential surface of the tub 20 are respectively disposed adjacent to the side panels 12 and 13 of the cabinet.

Accordingly, a space in which the induction module I is installed may be secured in a portion between an upper portion of the outer circumferential surface of the tub 20 and a top panel of the cabinet 10 of a space between an inner surface of the cabinet 10 and the outer circumferential surface of the tub 20. In other words, the induction module I may be installed on a portion of the outer circumferential surface of the tub 20 disposed upwardly of or over top of the rotation shaft 43.

Because the tub 20 is formed in a cylindrical shape and disposed inside the cabinet 10 formed in a rectangular parallelepiped shape, a space between each of both side portions of the outer circumferential surface of the tub 20 and the cabinet 10 may be the widest.

For example, a spacing between the outer circumferential surface of the tub 20 and an edge of the cabinet 10 may be the greatest at a position of the outer circumferential surface of the tub 20 with 45 degrees with respect to a vertical line crossing a center of the rotation shaft (e.g., there is more space in the diagonal corner areas). The spacing between the outer circumferential surface of the tub 20 and the cabinet 10 may gradually become narrower in directions toward positions with 0 degrees and 90 degrees with respect to the vertical line based on the 45 degrees.

Therefore, considering an installation space, the induction module I may be preferably disposed on a region of the outer circumferential surface of the tub 20 where a center O thereof forms an angle of 45 degrees with the vertical line crossing the center of the rotation shaft 43.

However, because of the width of the base 100, when the center O is biased by 45 degrees, the side surface of the induction module I is biased by an angle greater than 45 degrees and is disposed closer to the side panel 13 of the cabinet 10.

Therefore, when vibration is transmitted from the tub 20, the induction module I may collide with or vibrate against the side panel 13 of the cabinet, or the diameter of the tub 20 may need to be reduced to avoid the collision between the induction module I and the side panel 13 of the cabinet.

Therefore, it is preferable that the center O of the induction module I is biased within a range from 0 degree to 45 degree with respect to the vertical line crossing the center of the rotation shaft 43 (e.g., 45 degrees or less).

The center O of the induction module I may correspond to a center O of the base 100 of the induction module I in the width direction. That is, the center O may correspond to an interior of the wound coil 600 and may correspond to a center of the width of the seating surface 120.

In addition, the center O may be a point corresponding to a fan installation portion 440 which can correspond to or include the blowing fan.

As a result, the induction module I of the laundry treating apparatus according to the present disclosure may be disposed to be biased by an angle within a range from 0 degrees to 45 degrees from the upper end of the tub 20 based on the rotation shaft 43. In other words, the positioning of the center O of the induction module I can be slightly towards one side of the cabinet 10 relative of a center C of the tub 20.

In one example, as the center O of the induction module I is disposed to be biased by an angle closer to 45 degrees, a center of gravity of the tub 20 may become more biased toward the side panel 13.

In addition, when the vibration occurs in the tub 20, stability may not be adequately secured because an amplitude of the vibration becomes greater in a left and right direction due to the biased center of gravity of the tub 20.

Therefore, it is preferable that the center O of the induction module I is disposed to be biased by an angle within a range from 0 degrees to 10 degrees (e.g., 5 degrees) from the upper end of the tub 20 based on the rotation shaft 43. For example, the positioning of the center O of the induction module I can be disposed slightly offset from a center C of the tub 20. In this way, enough space can be secured within the cabinet 10 for housing the induction module I, a volume of the tub 20 can be made as a large as possible, electrical interference with other components can be minimized, and vibration of the tub 20 can be minimized or kept within an acceptable level.

In other words, even when the induction module I is disposed on top of the outer circumferential surface of the tub 20 to be biased toward one side, the induction module I may be disposed as close as possible to the highest point or the upper end of the tub 20. For example, the induction module I may be disposed to be biased by an angle of 5 degrees from the upper end of the tub 20 based on the rotation shaft 43.

As a result, one surface of the induction module I may be positioned on the top of the tub 20 to face one side panel 12, and the other surface of the induction module I may be positioned on the top of the tub 20 to face the other side panel 13.

In one example, the induction module I may be disposed on the top of the tub 20 to be biased to one side in order to avoid physical and electrical interference with the components.

The detergent box 53 may be disposed in a space between the upper portion of the outer circumferential surface of the tub 20 and the one side panel 12 of the cabinet. The detergent box 53 may be fixed to the one side panel 12 and disposed in an inner corner space of the cabinet 10. For example, the detergent box 53 can be disposed at one corner (or vertex) of the cabinet 10, and the positioning of the induction module I can be shifted slightly closer toward the other corner opposite to the detergent box 53.

Therefore, when the induction module I is coupled to the outer circumferential surface of the tub 20, the induction module I is disposed between the detergent box 53 and the other side panel 13 facing the one side panel 12.

In this regard, the induction module I may be biased in a direction away from the detergent box 53 from the upper end of the tub 2. Thus, the side surface of the induction module I may be prevented from interfering with the detergent box 53, so that a volume of the detergent box 53 or the width of the induction module I may be secured as much as possible.

In one example, the induction module I may be disposed on the top of the tub 20 to be biased closer to the detergent box 53 than to the other side panel 13.

That is, an angle between the center O of the induction module I and the other side panel 13 may be greater than an angle between the center O of the induction module I and the detergent box 53. In addition, a spacing from one side surface of the induction module I to the other side panel 13 may be greater than a spacing from the other side surface of the induction module I to the detergent box 53.

In other words, although the induction module I is biased to be away from the detergent box 53, the biased angle thereof may be minimized, so that the induction module I may occupy the upper end of the tub 20.

Thus, the center of gravity of the induction module I may be located closer to the upper end of the tub 20 than to the side portion of the outer circumferential surface of the tub 20, so that the center of gravity of the entire tub 20 may be located close to the rotation shaft 43. For example, the center of gravity of the induction module I can be aligned much closer to a center gravity of the tub 20 than towards one of the sides of the cabinet 10.

As a result, vibrational stability of the tub 20 and stability of the coupling between the tub 20 and the induction module I may be ensured, and interference between the detergent box 53 and the induction module I may be avoided while securing maximum volumes of the detergent box 53 and the induction module I.

Springs 72 of the support of the laundry treating apparatus according to the present disclosure may be coupled to the side panels 12 and 13 to support the upper portion of the tub 20.

For example, the spring 72 may attenuate the vibration while supporting the tub 20 as one end thereof is coupled to the other side panel 13 and the other end thereof is coupled to an upper side surface of the tub 20.

In this regard, because the spring 72 is made of a metal material to secure a spring force, the spring 72 may be heated by the electromagnetic field generated by the induction module I. In this case, a safety accident may occur due to unnecessary heating of the side panels 13 or flow of the induced current, and a problem in that the tub 20 is heated and the tub 20 is thermally damaged or melted may occur. At the same time, the heating performance of heating the drum 30 may be reduced.

Accordingly, the center O of the induction module I may be disposed on the top of the tub 20 to be biased toward the spring 72, but may be disposed closer to the detergent box 53 than to the spring 72. Accordingly, the induction module I may secure the installation space thereof, avoid the interference with the detergent box 53, and prevent unnecessary electrical interference thereof on the support. For example, the spring 72 can be disposed at a corner of the cabinet 10 or near where two panels of the cabinet 10 meet, and the center O of the induction module I can be positioned closer to the center C of the tub 20 than towards the spring 72. According to another embodiment, the spring 72 can be replaced by a different type of support or dampener.

FIG. 9 shows a positional relationship between an induction module I and a control panel 15 of a laundry treating apparatus according to an embodiment of the present disclosure.

Because the induction module I generates a relatively strong magnetic field, the control panel 15 composed of as an electronic circuit board and the like may be vulnerable to the magnetic field.

Therefore, it may be desirable to place the control panel 15 as far away from the induction module I as possible.

However, because the control panel 15 is configured to control the induction module I, when the control panel 15 is too far from the induction module I, it may become difficult to install or place a control line for controlling the induction module I or unnecessary noise may occur from the control line.

Because it is difficult to install the induction module I on the side portion or a lower portion of the outer circumferential surface of the tub in consideration of positional relationships with the cabinet and the drainage and the like, it is desirable that the induction module I is disposed on the top of the tub and the control panel 15 is also placed upwardly of the rotation shaft.

Given these considerations, the control panel 15 configured to control at least one of the driver 40 and the induction module I may be supported on the other side panel 13.

Thus, the induction module I may be coupled to and disposed on the top of the tub 20 in a space between the detergent box 53 and the control panel 15. In other words, the control panel 15 and the detergent box 53 can be disposed at opposite corners of the cabinet 10 with the induction module I positioned therebetween (e.g., see FIG. 9).

The control panel 15 may control the induction module I via the control line. As the induction module I is disposed closer to the control panel 15, the control line is shortened, so that the noise or the like may be reduced and thus a performance thereof may be improved.

Accordingly, the induction module I may be disposed on the top of the tub 20 to be biased in a direction away from the detergent box 53 and closer to the control panel 15.

However, because the induction module I generates the electromagnetic field, the electromagnetic field may be applied to the control panel 15, and the control panel 15 having complex electronic circuits and processing devices may be very vulnerable to the electromagnetic field.

Accordingly, the induction module I may be disposed closer to the detergent box 53 than to the control panel 15 while being biased toward the control panel 15. A spacing L2 between the induction module I and the control panel 15 may be greater than a spacing L1 between the induction module I and the detergent box 53 (e.g., L2>L1).

In addition, even when the induction module I is disposed on the top of the tub to be biased toward the side portion of the outer circumferential surface of the tub, the induction module I may be disposed biased toward the side surface within a range occupying the upper end of the tub. That is, even when the induction module I is disposed on the top of the tub to be biased toward the side portion of the outer circumferential surface of the tub, a right side surface of the induction module I may be disposed at a right side of the upper portion of the outer circumferential surface of the tub, and a left side surface of the induction module I may be disposed at a left side of the upper portion of the outer circumferential surface of the tub. In other words, even when the induction module I is disposed on the top of the tub to be biased to the right or left, the entire induction module may not be disposed on a right or left side of the upper end of the tub.

As a result, even when the induction module I is disposed on the top of the tub to be biased toward the control panel 15, the spacing between the induction module I and the control panel 15 may be maintained at a distance equal to or greater than the safety distance L2.

In addition, even when the induction module I is disposed to be biased away from the detergent box 53, the safety distance from the control panel 15 may be adequately secured, so that unnecessary influence on the control panel 15 may be prevented.

In addition, an angle between the induction module I and the control panel 15 based on the rotation shaft 43 may be set greater than an angle between the induction module I and the detergent box 53 based on the rotation shaft 43.

As a result, the induction module I may avoid the physical interference with the detergent box 53 compared to a situation in which the induction module I is installed at a center of the upper end of the tub 20, and may secure the safety distance that is far enough away so that the induction module I does not have an electromagnetic effect on the control panel 15 even when the induction module I becomes closer to the control panel 15.

FIG. 10 shows a positional relationship between an induction module I and a sensor unit or sensor module of a laundry treating apparatus according to the present disclosure.

The tub 20 may include one or more sensors 85 capable of sensing a state inside the tub.

The sensors 85 may include at least one of a temperature sensor 81 for sensing a temperature inside the tub 20 and a water level sensor 82 for sensing a water level inside the tub 20.

The temperature sensor 81 and the water level sensor 82 may be controlled by being connected to a control line 83 of the control panel 15, and may be coupled to the top surface of the tub 20.

The sensors 85 may be disposed as close to the control panel 15 as possible to block noise or the like.

Accordingly, the induction module I may be disposed between the detergent box 53 and the sensor 85, and the sensor 85 may be disposed on the top of the tub at a location between the induction module I and the other side panel 13.

In one example, because the sensor 85 is also composed of the electronic products, it may be vulnerable to the electromagnetic field generated by the coil 600 of the induction module I.

Accordingly, the induction module I may be disposed on the top of the tub 20 to be biased in a direction away from the detergent box 53 and closer to the sensor 85, but may be disposed closer to the detergent box 53 than to the sensor 85.

A distance L3 between the induction module I and the sensor 85 may be greater than the distance L1 between the induction module I and the detergent box 53 (e.g., L3>L1).

In addition, a distance L4 from the sensor 85 to the control panel 15 may be smaller than the distance L3 from the induction module I to the sensor 85 (e.g., L4<L3). Accordingly, because the sensor 85 is disposed closer to the control panel 15 than to the induction module I, the influence of the induction module I on the sensor 85 may be minimized.

In addition, because length between the sensor 85 and the control panel 15 is shortened, occurrence of noise in a signal of the sensor 85 may be minimized.

FIG. 11 shows a positional relationship between an induction module I, a water supply valve 51, and a breathing hole 90 of a laundry treating apparatus according to an embodiment of the present disclosure.

The water supply valve 51 may be coupled to the rear surface of the cabinet 10. The water supply valve 51 may be controlled by being connected to the control panel 15 via the control line.

Therefore, because the water supply valve 51 is formed as an electronic product, it may be vulnerable to the electromagnetic field generated by the coil 600 of the induction module I.

Accordingly, the induction module I may be disposed to be biased to one side from the upper end of the tub, but biased in a direction away from the water supply valve 51.

The distance L4 between the induction module I and the water supply valve 51 may be greater than the distance L1 between the induction module I and the detergent box 53 (e.g., L4>L1). Thus, influence of the induction module I on the water supply valve 51 may be minimized.

In one example, the tub 20 may include a breathing hole 90 that extends through the upper portion of the outer circumferential surface 21 to allow the inside of the tub and the inside of the cabinet to be in communication with each other. The breathing hole 90 is a component that prevents children and animals from suffocating even when they are trapped in the drum 30. The breathing hole 90 should be defined at the top of the tub 20 to prevent water from flowing out of the tub 20.

Since the breathing hole 90 is disposed closer to the upper end of the tub 20, the outflow of the water may be blocked.

Therefore, the induction module I may be disposed to be biased to one side from the upper end of the tub to avoid the breathing hole 90.

However, in order to prevent the induction module I from interfering with the control panel 15, the support 70, or the like, the induction module I may be disposed to be biased to one side within the range of occupying the upper end of the tub 20.

Therefore, the breathing hole 90 may be defined to be biased to the other side from the upper end of the tub to be installed at the highest possible vertical level. For example, the breathing hole 90 may be defined on a side opposite to a side onto which the induction module I is biased on the top of the tub 20. In other words, the positions of the breathing hole 90 and the induction module I can be slightly shifted towards opposite sides of the cabinet 10.

That is, when the induction module I is disposed to be biased in a clockwise direction with respect to the rotation shaft 43, the breathing hole 90 may be defined to be biased in a counterclockwise direction with respect to the rotation shaft 43.

As a result, the induction module I may be disposed closer to the breathing hole than to the side panel 13 of the cabinet, the induction module may be disposed to be biased to one side from the upper end of the tub in the direction away from the detergent box, and the breathing hole may be defined between the detergent box and the induction module.

The present disclosure may be implemented in various forms, so that the scope of the rights thereof is not limited to the above-described embodiment. Therefore, when the modified embodiment includes components of claims of the present disclosure, it should be regarded as belonging to the scope of the present disclosure.

The invention claimed is:

1. A laundry treating apparatus comprising:

a cabinet including an inlet, a first side panel, and a second side panel opposite to the first side panel;

a tub disposed inside the cabinet, the tub being configured to hold water;

a drum disposed inside the tub, the drum including a conductive material and being configured to rotate;

a driver including a rotation shaft, the driver being disposed at a rear of the tub and being configured to rotate the drum;

an induction module coupled to an outer circumferential surface of the tub, the induction module being configured to generate a magnetic field for heating the drum;

a detergent box disposed adjacent to the first side panel of the cabinet, the detergent box being configured to hold detergent; and a control panel disposed adjacent to the second side panel, the control panel being configured to control at least one of the driver and the induction module, wherein a position of the induction module is shifted by an angle within a range from 0 degrees to 45 degrees away from an upper end of the tub that vertically overlaps with the rotation shaft of the driver, wherein the induction module is disposed between the detergent box and the control panel, and wherein the induction module is disposed closer to the detergent box than to the control panel.

2. The laundry treating apparatus of claim 1, wherein the angle is within a range from 0 degrees to 10 degrees from the upper end of the tub.

3. The laundry treating apparatus of claim 1, wherein the induction module does not overlap with a region forming an angle with the upper end of the tub within a range from 45 degrees to 90 degrees.

4. The laundry treating apparatus of claim 1, wherein a first spacing distance between the induction module and the detergent box is less than a second spacing distance between the induction module and the control panel.

5. The laundry treating apparatus of claim 1, wherein an angle between the induction module and the control panel based on the rotation shaft is greater than an angle between the induction module and the detergent box based on the rotation shaft.

6. The laundry treating apparatus of claim 1, further comprising a sensor disposed between the induction module and the second side panel, the sensor being coupled to the tub, wherein the sensor is configured to sense a water level of water within the tub or a temperature of the tub, and wherein the induction module is disposed closer to the detergent box than to the sensor.

7. The laundry treating apparatus of claim 6, wherein the sensor is disposed closer to the control panel than to the induction module.

8. The laundry treating apparatus of claim 1, further comprising a support coupled to the second side panel, the support being configured to support the tub, wherein the induction module is disposed closer to the detergent box than to the support.

9. The laundry treating apparatus of claim 1, further comprising a water supply valve coupled to a rear surface of the cabinet, the water supply valve being configured to supply the water to the detergent box, wherein the induction module is spaced apart from the water supply valve.

10. The laundry treating apparatus of claim 9, wherein the induction module is spaced apart from the water supply valve by a third spacing distance that is greater than a first spacing distance between the induction module and the detergent box.

11. The laundry treating apparatus of claim 1, further comprising a breathing hole in the tub, wherein the induction module is spaced apart from the breathing hole.

12. The laundry treating apparatus of claim 11, wherein the induction module is spaced apart from the detergent box, and wherein the breathing hole is between the detergent box and the induction module.

13. The laundry treating apparatus of claim 11, wherein the induction module is disposed closer to the breathing hole than to a side panel of the cabinet.

14. A laundry treating apparatus comprising:

a cabinet including an inlet;

a tub disposed inside the cabinet, the tub being configured to hold water;

a drum disposed inside the tub, the drum including a conductive material and being configured to rotate;

a detergent box disposed adjacent to a first upper corner of the cabinet, the detergent box being configured to hold detergent;

a controller disposed adjacent to a second upper corner of the cabinet, the controller being configured to control an operation of the laundry treating apparatus; and an induction module coupled to the tub, the induction module being configured to generate a magnetic field for heating the drum, wherein a center of the induction module is offset relative to a vertical line intersecting with a center of the tub, and wherein the induction module is disposed between the detergent box and the controller, and wherein the induction module is disposed closer to the detergent box than to the controller.

15. The laundry treating apparatus of claim 14, wherein the center of the induction module is shifted by an angle within a range from 0 degrees to 45 degrees away from the vertical line intersecting with the center of the tub.

16. The laundry treating apparatus of claim 14, wherein the induction module includes:

a coil configured to generate the magnetic field; and a plurality of magnets, and wherein the coil is disposed between the tub and the plurality of magnets.

17. The laundry treating apparatus of claim 14, further comprising at least one sensor disposed on the tub, wherein the induction module is disposed closer to the detergent box than the at least one sensor.

* * * * *